US011484163B1

(12) United States Patent
Zuckerman

(10) Patent No.: US 11,484,163 B1
(45) Date of Patent: Nov. 1, 2022

(54) ELECTRICAL EQUIPMENT DUST COLLECTION SYSTEM

(71) Applicant: Christopher J. Zuckerman, Auburndale, FL (US)

(72) Inventor: Christopher J. Zuckerman, Auburndale, FL (US)

( * ) Notice: Subject to any disclaimer, the term of this patent is extended or adjusted under 35 U.S.C. 154(b) by 115 days.

(21) Appl. No.: 17/120,810

(22) Filed: Dec. 14, 2020

(51) Int. Cl.

| | |
|---|---|
| ***A47L 9/02*** | (2006.01) |
| ***A47L 5/14*** | (2006.01) |
| ***B08B 5/02*** | (2006.01) |
| ***A47L 9/30*** | (2006.01) |
| ***A47L 9/32*** | (2006.01) |
| ***B08B 5/04*** | (2006.01) |

(52) U.S. Cl.
CPC ..... *A47L 5/14* (2013.01); *A47L 9/02* (2013.01); *A47L 9/30* (2013.01); *A47L 9/322* (2013.01); *B08B 5/02* (2013.01); *B08B 5/04* (2013.01)

(58) Field of Classification Search
CPC ... A47L 9/02; A47L 9/30; A47L 9/322; A47L 9/04
USPC ..... 15/345, 363, 37, 300, 346; 134/21, 37, 134/221
See application file for complete search history.

(56) References Cited

U.S. PATENT DOCUMENTS

| | | | | |
|---|---|---|---|---|
| 3,897,604 | A * | 8/1975 | Weimer | B23Q 11/006 15/345 |
| 4,205,412 | A * | 6/1980 | Weber | B01D 50/60 15/345 |
| 4,670,062 | A * | 6/1987 | Lester | B60S 3/042 15/345 |
| 4,697,300 | A | 10/1987 | Warlop | |
| D360,502 | S | 7/1995 | Hollinger | |
| 5,970,556 | A | 10/1999 | Nemoto | |
| 7,000,287 | B2 | 2/2006 | Valentini | |
| 8,387,208 | B2 | 3/2013 | Davis | |
| 8,464,807 | B2 | 7/2013 | Johnen et al. | |
| 8,580,044 | B2 | 11/2013 | McCormick et al. | |
| 8,826,489 | B2 * | 9/2014 | Oh | A47L 9/2868 15/322 |
| 8,840,730 | B1 * | 9/2014 | Thonghara | B08B 5/02 15/345 |
| 9,629,510 | B1 | 4/2017 | Willhoyt | |
| 10,369,576 | B2 | 8/2019 | Cho et al. | |
| 2006/0096057 | A1 * | 5/2006 | Chatfield | A47L 9/2857 15/339 |
| 2012/0118327 | A1 * | 5/2012 | Mazmanyan | B08B 15/00 15/300.1 |

* cited by examiner

*Primary Examiner* — Michael D Jennings
(74) *Attorney, Agent, or Firm* — Cramer Patent & Design, PLLC; Aaron R. Cramer

(57) ABSTRACT

The electrical equipment dust collection system may comprise a cover panel, a vacuum port, a blow gun, a handle, and a light strip. The electrical equipment dust collection system may be a tool for removing dust from electrical equipment located inside of an equipment enclosure. The cover panel may be adapted to cover an open side of the equipment enclosure. An air hose fitting on the blow gun may be adapted to removably couple to a source of compressed air and the blow gun may direct a stream of air at the electrical equipment such that the dust is dislodged from the electrical equipment. A vacuum fitting on the vacuum port may be adapted to removably couple to a vacuum hose of a vacuum cleaner such that the vacuum cleaner may suction the dust out of the equipment enclosure.

15 Claims, 7 Drawing Sheets

ELECTRICAL EQUIPMENT DUST COLLECTION SYSTEM

RELATED APPLICATIONS

Not applicable.

FIELD OF THE INVENTION

The present invention relates generally to a dust collection system and more specifically to a dust collection system for electrical equipment.

BACKGROUND OF THE INVENTION

As anyone who performs a lot of mechanical work will attest, nothing beats having the proper tool for a job. The proper tool can save time, save money, produce a higher quality job, reduce damage to equipment, and provide for the increased safety of the worker. Each field of mechanical work has its own type of specialty tools, each performing a specialized task.

One field where there has been a need for such a specialized tool is when removing dust from inside of electrical equipment such as switchgear or motor control centers to ensure proper and safe operation. Many workers resort to the use of compressed air as it is very effective in lifting the dust from every crack and crevice. Unfortunately, such action creates a dust cloud that can be explosive in nature. It also simply allows the dust to settle back down elsewhere. Vacuuming is often recommended as it removes the dust, but it is not effective at removing all of the dust. Accordingly, there exists a need for a means by all dust can be removed from electrical equipment in a manner which addresses the current shortcomings. The development of the electrical equipment dust collection system fulfills this need.

SUMMARY OF THE INVENTION

To achieve the above and other objectives, the present invention provides for an electrical equipment dust collection system which has a cover panel adapted to cover an open side of an equipment enclosure and a vacuum port having a vacuum fitting and a vacuum flare. The vacuum port is adapted to removably couple to a vacuum hose of a vacuum cleaner such that the vacuum cleaner suctions dust out of the equipment enclosure and the vacuum port is an interface for coupling the vacuum hose of the vacuum cleaner. The electrical equipment dust collection system also has a blow gun having an air hose fitting, a boot, and an air wand. The blow gun is adapted to removably couple to a source of compressed air and the blow gun directs a stream of air at a piece of electrical equipment such that the dust is dislodged from the piece of electrical equipment.

The air hose fitting is an attachment point for coupling an air hose connected to the source of compressed air, and the air wand is a tube projecting from the air hose fitting on the rear of the cover panel. The electrical equipment dust collection system also has handle including a grasping point for holding the cover panel in place against the equipment enclosure and a light strip illuminating the interior of the equipment enclosure such that the dust is made easier to view. The light strip is coupled to the rear side of the cover panel. The light strip includes a plurality of lights, an on/off control, and a battery.

The open side of the equipment enclosure may result from a door of the equipment enclosure being opened or may result from the door of the equipment enclosure being removed. The cover panel may be a rigid, non-conductive plate operable to cover the open side of the equipment enclosure. The cover panel may be rectangular-shaped. The vacuum fitting may be located at a center of the vacuum flare. The vacuum fitting may provide a friction fit coupling to the vacuum hose. The vacuum fitting may include a 90-degree angle within a plane that is parallel to the cover panel such that the vacuum hose hangs down while the piece of electrical equipment dust collection system is in place on the equipment enclosure. The vacuum fitting may rotate such that the electrical equipment dust collection system is used in a plurality of orientations.

The vacuum flare may be a projection of the cover panel away from the equipment enclosure. The vacuum flare may be a dome or a frustum of a cone. The vacuum flare may be transparent to provide a view of an interior of the equipment enclosure. The boot may be a semi-rigid sheath that holds the air hose fitting above the cover panel or a corrugated cone. The boot may couple to a flange located on the front of the cover panel or may be adapted to flex when manipulated such that the air wand is reoriented in a plurality of directions. The air hose fitting may be located at the center of the boot. The handle may be located on the front side of the cover panel opposite the blow gun. The lights may be one or more white light-emitting diodes.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
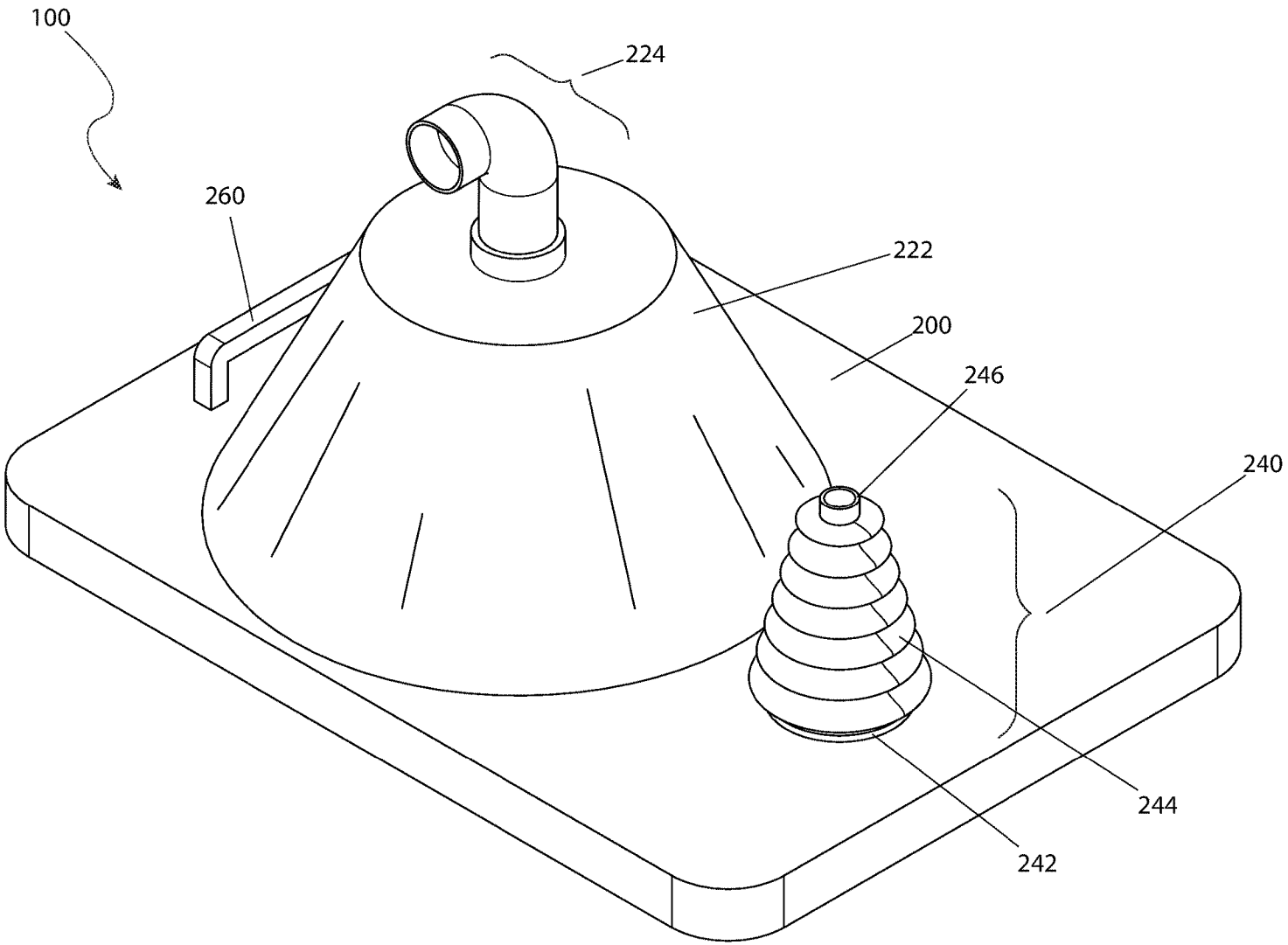
FIG. 1 is an isometric view of an electrical equipment dust collection system 100, according to an embodiment of the present invention.
Figure 2:
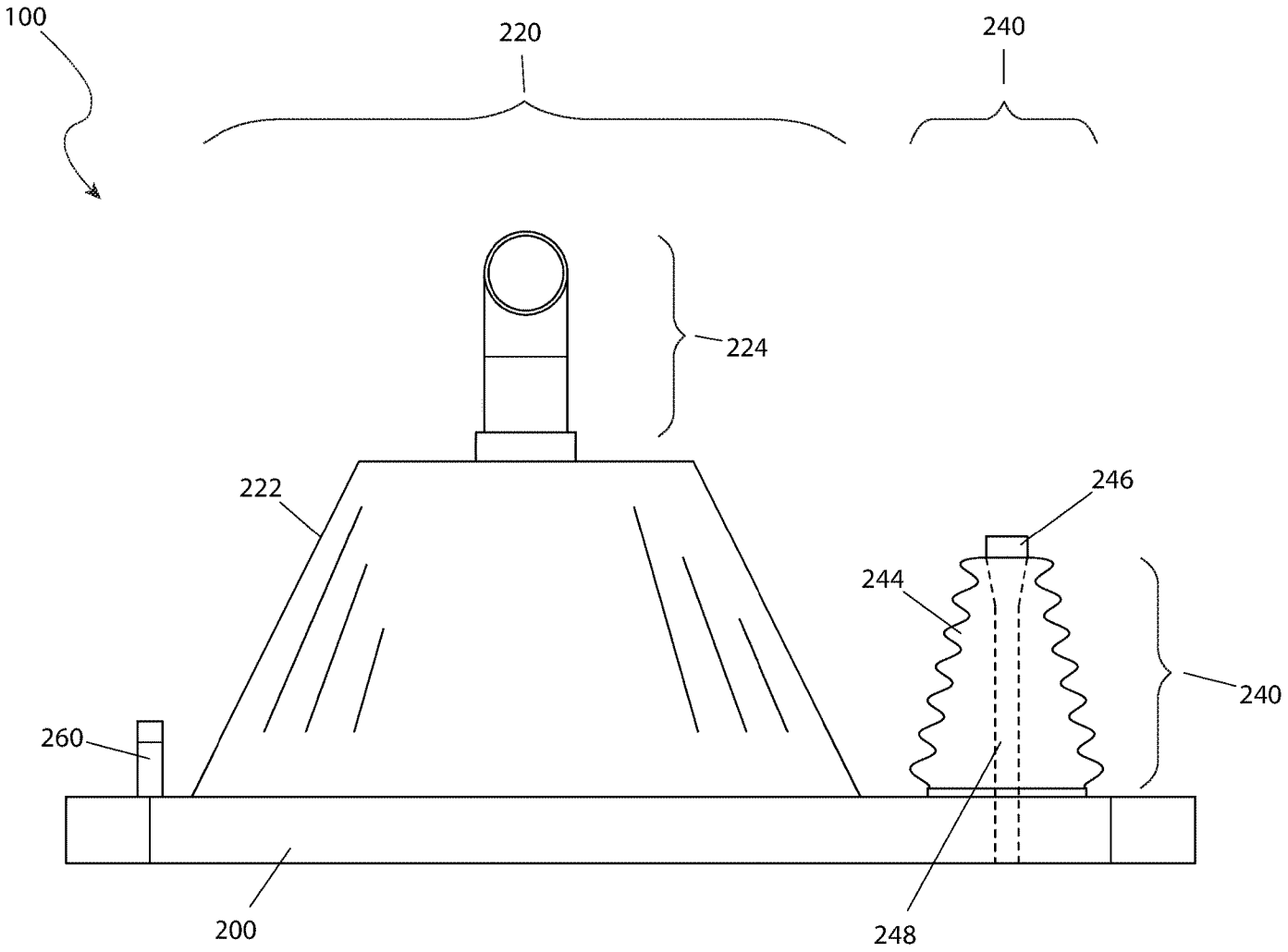
FIG. 2 is a bottom view of an electrical equipment dust collection system 100, according to an embodiment of the present invention.
Figure 3:
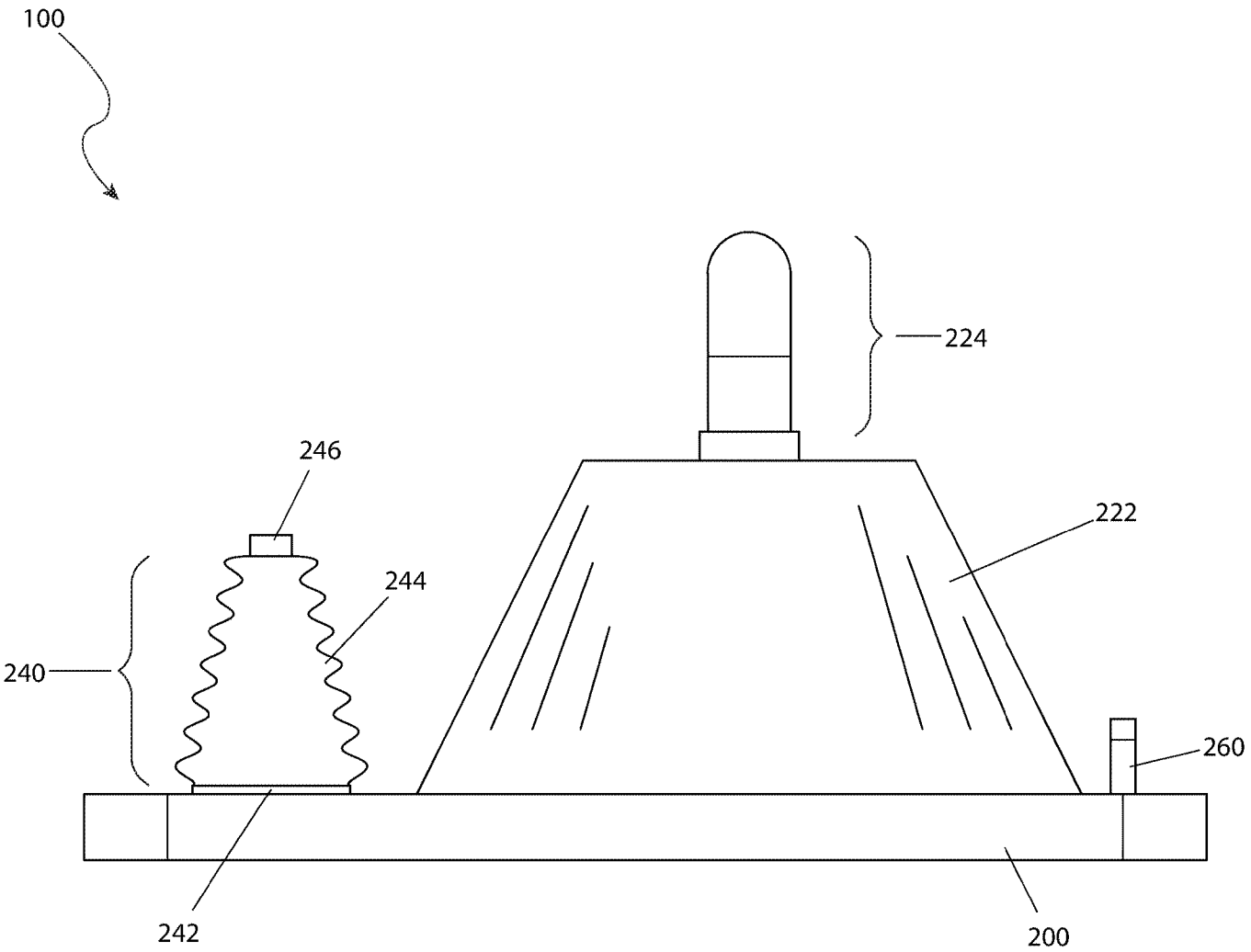
FIG. 3 is a top view of an electrical equipment dust collection system 100, according to an embodiment of the present invention.
Figure 4:
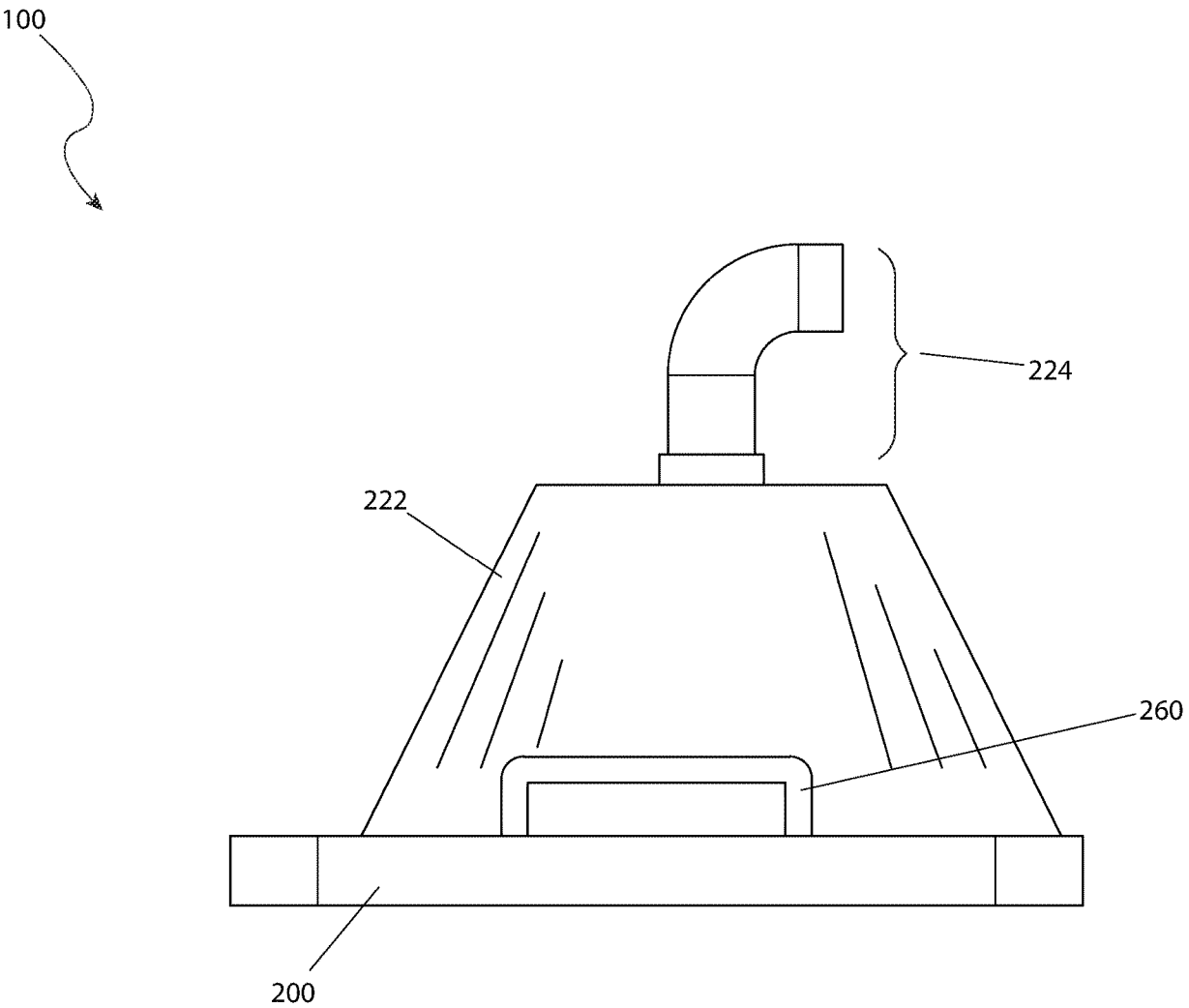
FIG. 4 is a left side view of an electrical equipment dust collection system 100, according to an embodiment of the present invention.
Figure 5:
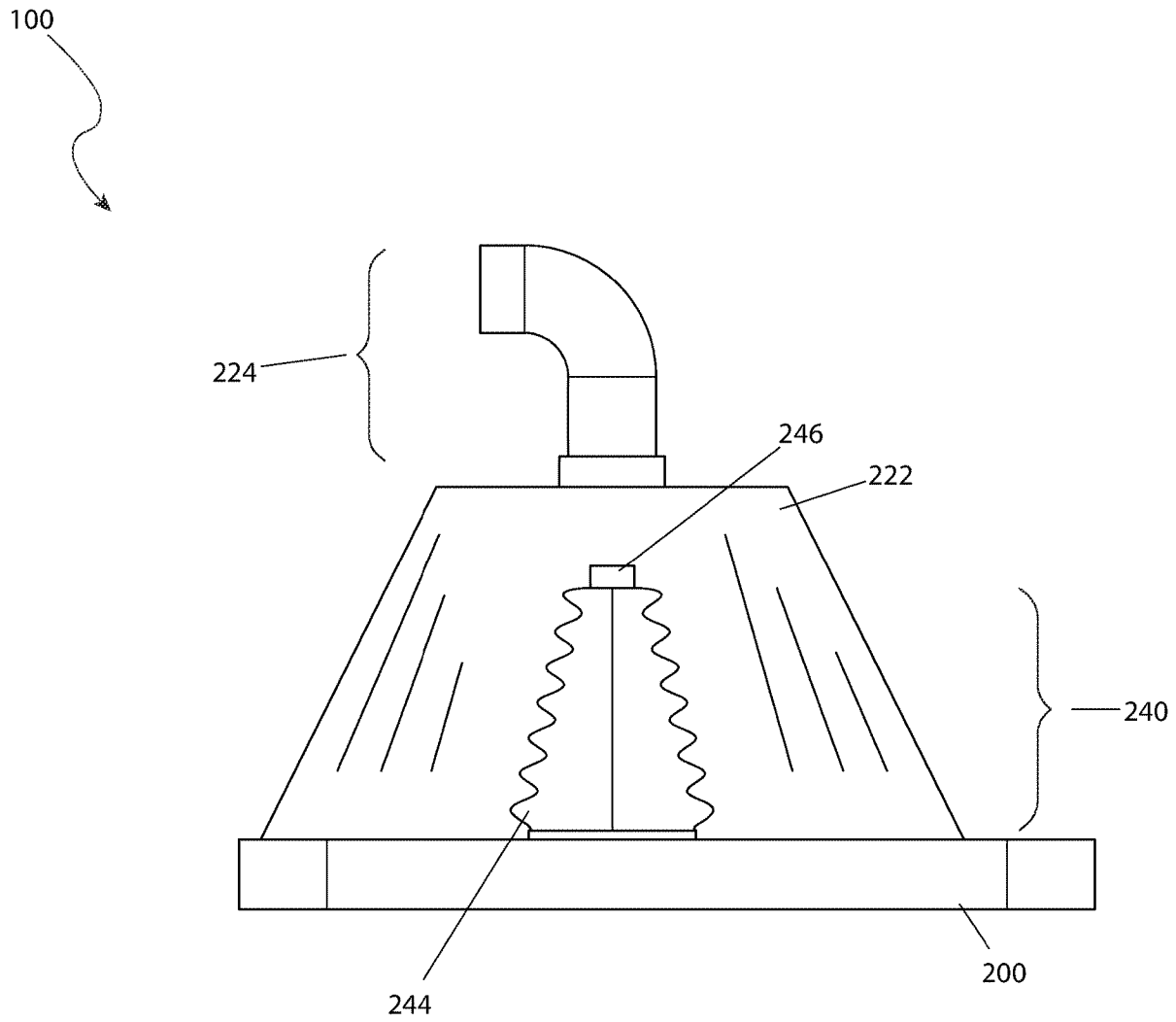
FIG. 5 is a right side view of an electrical equipment dust collection system 100, according to an embodiment of the present invention.
Figure 6:
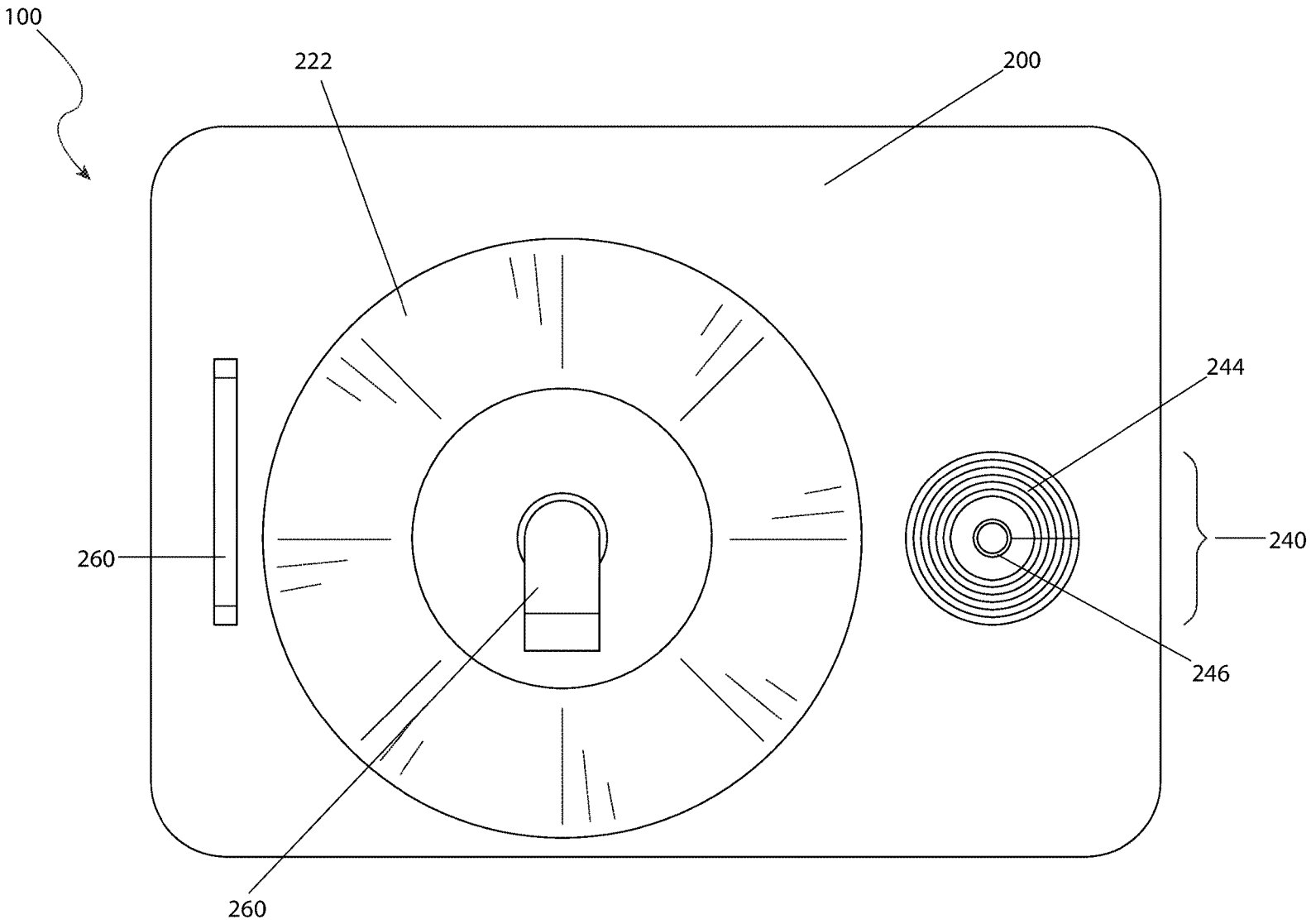
FIG. 6 is a front view of an electrical equipment dust collection system 100, according to an embodiment of the present invention; and, FIG. 7 is a rear view of an electrical equipment dust collection system 100, according to an embodiment of the present invention.
Figure 7:
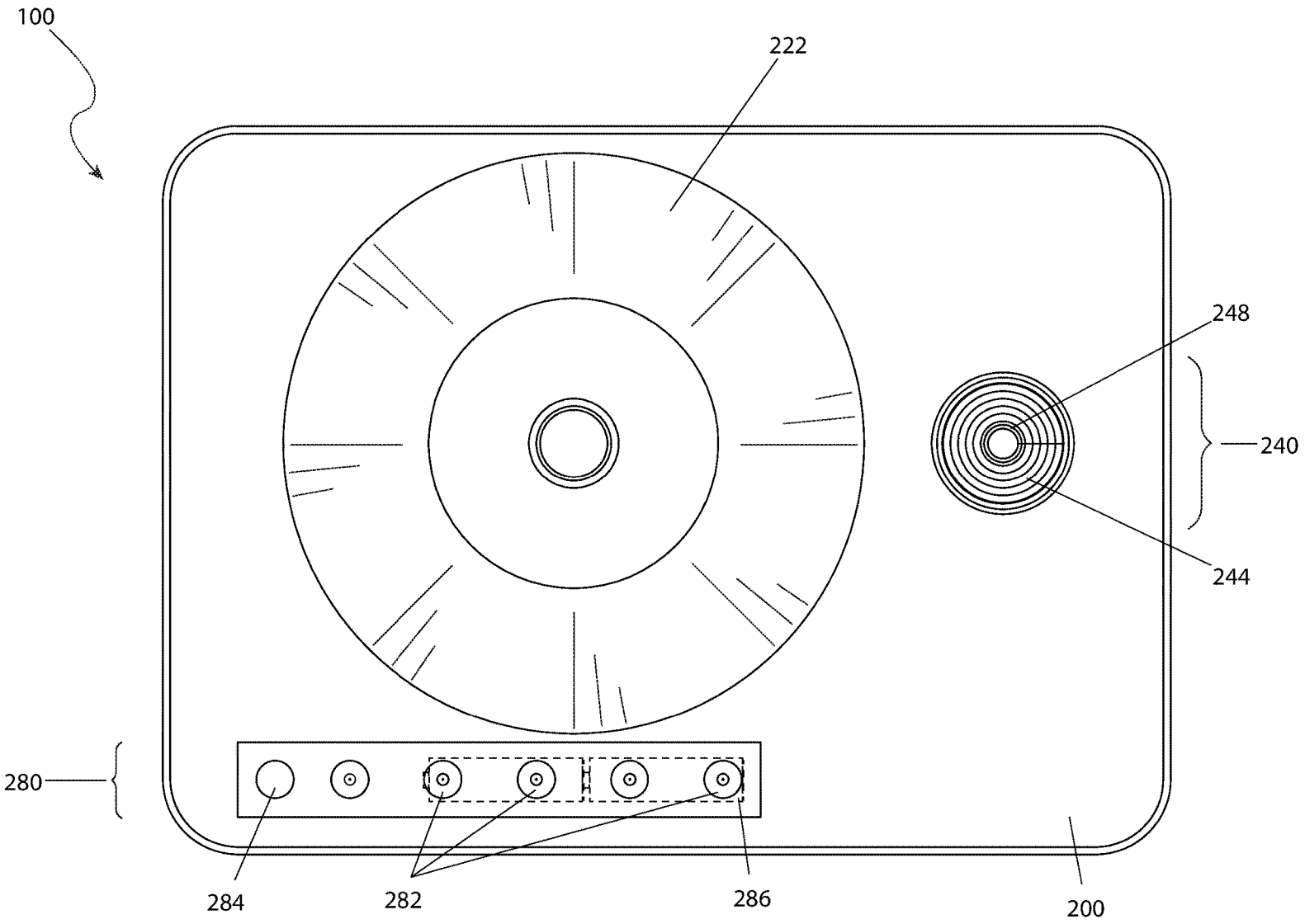

100 electrical equipment dust collection system
200 cover panel
220 vacuum port
222 vacuum flare
224 vacuum fitting
240 blow gun
242 flange
244 boot
246 air hose fitting

248 air wand
260 handle
280 light strip
282 plurality of lights
284 on/off control
286 battery

DESCRIPTION OF THE INVENTION

The present invention is directed to an electrical equipment dust collection system (herein described as the "invention") 100. The invention 100 may comprise a cover panel 200, a vacuum port 220, a blow gun 240, a handle 260, and a light strip 280. The invention 100 may be a tool for removing dust from electrical equipment located inside of an equipment enclosure. The cover panel 200 may be adapted to cover an open side of the equipment enclosure. An air hose fitting 246 on the blow gun 240 may be adapted to removably couple to a source of compressed air and the blow gun 240 may direct a stream of air at the electrical equipment such that the dust is dislodged from the electrical equipment. A vacuum fitting 224 on the vacuum port 220 may be adapted to removably couple to a vacuum hose of a vacuum cleaner such that the vacuum cleaner may suction the dust out of the equipment enclosure. As a non-limiting example, the open side of the equipment enclosure may result from a door of the equipment enclosure being opened or removed.

The cover panel 200 may be a rigid, non-conductive plate operable to cover the open side of the equipment enclosure. In some embodiments, the cover panel 200 may be rectangular. Throughout this document, front side may refer to the side of the cover panel 200 that is oriented to be away from the equipment enclosure and rear side may refer to the side of the cover panel 200 that is oriented to touch the equipment enclosure.

The vacuum port 220 may be an interface for coupling the vacuum hose of the vacuum cleaner. The vacuum port 220 may comprise a vacuum flare 222 and the vacuum fitting 224. The vacuum flare 222 may be a projection of the cover panel 200 away from the equipment enclosure. In some embodiments, the vacuum flare 222 may be the shape of a dome or a frustum of a cone. The vacuum flare 222 may be transparent to provide a view of the interior of the equipment enclosure.

The vacuum fitting 224 may be an attachment point for coupling the vacuum hose of the vacuum cleaner. The vacuum fitting 224 may be located at the center of the vacuum flare 222. The vacuum fitting 224 may provide a friction fit coupling to the vacuum hose. The vacuum fitting 224 may comprise a 90 degree angle within a plane that is parallel to the cover panel 200 such that the vacuum hose may hang down while the invention 100 is in place on the equipment enclosure. The vacuum fitting 224 may rotate such that the invention 100 may be used in multiple orientations.

The blow gun 240 may be operable to introduce the stream of air from the source of compressed air into the equipment enclosure and to direct the stream of air towards the electrical equipment located within the equipment enclosure. The blow gun 240 may comprise a boot 244, the air hose fitting 246, and an air wand 248.

The boot 244 may be a semi-rigid sheath that may hold the air hose fitting 246 above the cover panel 200. In some embodiments, the boot 244 may have the shape of a corrugated cone. The boot 244 may couple to a flange 242 located on the front of the cover panel 200.

The air hose fitting 246 may be an attachment point for coupling an air hose connected to the source of compressed air. The air hose fitting 246 may be located at the center of the boot 244.

The air wand 248 may be a tube projecting from the air hose fitting 246 on the rear of the cover panel 200. The air wand 248 may be operable to direct the stream of air towards the electrical equipment. The boot 244 may be adapted to flex when manipulated by an operator such that the air wand 248 may be reoriented in multiple directions. The dust blown from the electrical equipment by the blow gun 240 may be suctioned out of the equipment enclosure through the vacuum port 220.

The handle 260 may be a grasping point for holding the cover panel 200 in place against the equipment enclosure. The handle 260 may be located on the front side of the cover panel 200 opposite the blow gun 240. The invention 100 may be adapted to be held in place by the operator by having the operator place a first hand on the handle 260 and a second hand on the blow gun 240.

The light strip 280 may illuminate the interior of the equipment enclosure such that the dust is made easier to view. The light strip 280 may be coupled to the rear side of the cover panel 200. The light strip 280 may comprise a plurality of lights 282, an on/off control 284, and a battery 286. The plurality of lights 282 may be sources of illumination when energized. As a non-limiting example, the plurality of lights 282 may be white light-emitting diodes (LED's). The plurality of lights 282 may be energized by the battery 286 when the on/off control 284 is in an ON position and may be deenergized when the on/off control 284 is in an OFF position.

In use, the vacuum hose of the vacuum cleaner may be coupled to the vacuum fitting 224 and the air hose may be coupled to the air hose fitting 246. With the vacuum cleaner and the source of compressed air operating, the operator may hold the invention 100 by the handle 260 and by the blow gun 240 and may lift the cover panel 200 to the open side of the equipment enclosure. While pressing the cover panel 200 against the equipment enclosure, the operator may release the stream of air and may aim the air wand 248 to direct the stream of air towards the electrical equipment by flexing the boot 244. The dust dislodged by the stream of air may be suctioned into the vacuum cleaner via the vacuum port 220. The operator may have visibility to the interior of the equipment enclosure via the transparent side of the vacuum flare 222.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An electrical equipment dust collection system, comprising:

a rectangular cover panel having a rigid and non-conductive plate, the cover panel covering an open side of an equipment enclosure;

a vacuum port having a vacuum fitting and a vacuum flare, the vacuum port is adapted to removably couple to a vacuum hose of a vacuum cleaner such that the vacuum cleaner suctions dust out of the equipment enclosure and the vacuum port is an interface for coupling the vacuum hose of the vacuum cleaner;

a blow gun having an air hose fitting, a boot, and an air wand, the blow gun is adapted to removably couple to a source of compressed air and the blow gun directs a stream of air at a piece of electrical equipment such that the dust is dislodged from the piece of electrical equipment, the air hose fitting is an attachment point for coupling an air hose connected to the source of compressed air, and the air wand is a tube projecting from the air hose fitting on the rear of the cover panel;

a handle including a grasping point for holding the cover panel in place against the equipment enclosure; and a light strip illuminating the interior of the equipment enclosure such that the dust is made easier to view, the light strip is coupled to the rear side of the cover panel, and the light strip includes a plurality of lights, an on/off control, and a battery;

wherein the boot is a semi-rigid sheath that holds the air hose fitting above the cover panel;

wherein the boot couples to a flange located on the front of the cover panel;

wherein the air hose fitting is located at the center of the boot;

wherein the vacuum port is disposed on the front of the cover panel;

wherein the handle is disposed on the front of the cover panel; and wherein the vacuum port is disposed on the front of the cover panel between the handle and the flange.

2. The electrical equipment dust collection system, according to claim 1, wherein the open side of the equipment enclosure results from a door of the equipment enclosure being opened.

3. The electrical equipment dust collection system, according to claim 1, wherein the open side of the equipment enclosure results from the door of the equipment enclosure being removed.

4. The electrical equipment dust collection system, according to claim 1, wherein the vacuum fitting is located at a center of the vacuum flare.

5. The electrical equipment dust collection system, according to claim 1, wherein the vacuum fitting provides a friction fit coupling to the vacuum hose.

6. The electrical equipment dust collection system, according to claim 1, wherein the vacuum fitting includes a 90-degree angle within a plane that is parallel to the cover panel such that the vacuum hose hangs down while the piece of electrical equipment dust collection system is in place on the equipment enclosure.

7. The electrical equipment dust collection system, according to claim 1, wherein the vacuum fitting rotates such that the electrical equipment dust collection system is used in a plurality of orientations.

8. The electrical equipment dust collection system, according to claim 1, wherein the vacuum flare is a projection of the cover panel away from the equipment enclosure.

9. The electrical equipment dust collection system, according to claim 1, wherein the vacuum flare is a dome.

10. The electrical equipment dust collection system, according to claim 1, wherein the vacuum flare is a frustum of a cone.

11. The electrical equipment dust collection system, according to claim 1, wherein the vacuum flare is transparent to provide a view of an interior of the equipment enclosure.

12. The electrical equipment dust collection system, according to claim 1, wherein the boot is a corrugated cone.

13. The electrical equipment dust collection system, according to claim 1, wherein the boot is adapted to flex when manipulated such that the air wand is reoriented in a plurality of directions.

14. The electrical equipment dust collection system, according to claim 1, wherein the handle is located on the front side of the cover panel opposite the blow gun.

15. The electrical equipment dust collection system, according to claim 1, wherein the lights are one or more white light-emitting diodes.

* * * * *